United States Patent [19]

Cain

[11] Patent Number: 4,939,544

[45] Date of Patent: Jul. 3, 1990

[54] MASK FOR RADIATION EMITTING PANEL

[75] Inventor: James H. Cain, Churchville, N.Y.

[73] Assignee: Eastman Kodak Company, Rochester, N.Y.

[21] Appl. No.: 430,224

[22] Filed: Nov. 1, 1989

[51] Int. Cl.[5] ..... G03G 15/04

[52] U.S. Cl. ..... 355/228; 355/71; 355/218

[58] Field of Search ..... 355/207, 209, 210, 214, 355/216, 218, 219, 227, 228, 200, 71; 362/84

[56] References Cited

U.S. PATENT DOCUMENTS

| | | | |
|---|---|---|---|
| 4,080,067 | 3/1978 | Massengeil | 355/228 X |
| 4,090,788 | 5/1978 | Massengeil | 355/228 X |
| 4,248,517 | 2/1981 | Nishikawa | 355/71 X |
| 4,497,565 | 2/1985 | Rutten | 355/218 |
| 4,544,261 | 10/1985 | Ohtsuka | 355/214 X |

*Primary Examiner*—Fred L. Braun
*Assistant Examiner*—Susan D. Luddy
*Attorney, Agent, or Firm*—Leonard W. Treash

[57] ABSTRACT

A mask for an electroluminescent panel has an elongated aperture through which a moving photoconductive member is exposed. To prevent elongated side strips from bowing, a connecting strip of mask material runs obliquely to the direction of movement of the photoconductive member. Portions of one or both of the elongated side strips are missing to provide additional exposure to the member to compensate for exposure masked by the connecting strip.

8 Claims, 1 Drawing Sheet

MASK FOR RADIATION EMITTING PANEL

TECHNICAL FIELD

This invention relates to a mask for a radiation emitting panel, for example, an electroluminescent panel particularly useful in electrophotographic apparatus.

BACKGROUND ART

Electroluminescent panels have been used for many years in electrophotographic apparatus to expose a photoconductive member with uniform radiation. For example, they have been used as an interframe erase lamp, a pre-development erase lamp, a pre-cleaning erase lamp, and to control the primary charge placed on the photoconductor.

In such devices the panel is placed across the photoconductor either touching or extremely close to it and the photoconductive member moves past it. The amount of exposure given the photoconductive member is a function of the intensity of the illumination from the electroluminescent panel and the time each point on the photoconductive member is exposed to that illumination. In general, the level of illumination of the electroluminescent panel is constant across the panel. The time is a function of the in-track width of the panel and the speed of the photoconductive member.

Many of the applications mentioned above of the electroluminescent panel involve total discharge of the photoconductive member. In these applications the actual amount of exposure is not critical. When the electroluminescent panel is used between the primary charger and the exposure station in electrophotographic apparatus to control or vary the amount of charge entering the exposure station, the photoconductive member is only partly discharged, and it becomes important that the exposure be uniform across the photoconductor.

The in-track width of an electroluminescent panel is controlled by a mask with an elongated aperture. Conventionally, that mask is one wall of a plastic casing for the panel, with the aperture cut out of the wall. Unfortunately, typical requirements for the mask involve an extremely long thin aperture, for example, 345 mm. cross-track length by 6½ mm. in-track width. The panel is similarly thin, forcing the mask to have elongated narrow strips of plastic along each side. Although such strips may be connected to other walls of the casing, they have a tendency to bow in use. The bowing widens the aperture in the middle and causes the photoconductive member to receive greater exposure as it moves under it. This reduces the charge in the middle of the image area and adversely affects the electrostatic image produced.

DISCLOSURE OF THE INVENTION

It is the object of the invention to provide a mask for an elongated radiation emitting panel or the like which provides a uniform exposure for a member moving with respect to it.

These and other objects are accomplished by designing the mask to have at least one connecting strip of masking material within the intended exposure of the moving member. This connecting strip connects elongated side strips of the mask to maintain their relative position. The connecting strip runs obliquely with respect to the intended relative movement of the member. Portions of one or both of the elongated strips are missing to provide additional exposure to the member to compensate for exposure masked by the connecting strip.

It is within the scope of the invention to make the mask with the oblique connecting strip from a wall of the same plastic casing used in the prior art. However, according to a preferred embodiment the mask is formed from a separate thin plastic strip, which strip can be held between the panel and the casing.

BRIEF DESCRIPTION OF THE DRAWING

In the detailed description of the preferred embodiment of the invention presented below, reference is made to the accompanying drawings, in which.

BEST MODE OF CARRYING OUT THE INVENTION

Figure 1:
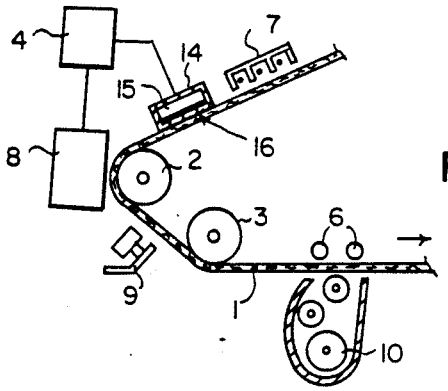
FIG. 1 is a side schematic view of a portion of an example of an electrophotographic apparatus in which the invention, is particularly usable.

According to FIG. 1 a portion of an electrophotographic apparatus is shown in which a radiation sensitive member, for example, a photoconductive member 1 is trained about a series of rollers including rollers 2 and 3, and is partially supported by skis 6. Photoconductive member 1 is moved past a series of stations including a primary charging station 7, an exposure station 8 and a development station 10.

As is well-known in the art the photoconductive member 1 is uniformly charged by the primary charging station 7, exposed by the exposure station 8 to create an electrostatic image, which electrostatic image is developed by the development station 10 creating a toner image which is utilized, for example, by transfer to a sheet of paper by means not shown. Exposure station 8 can be an optical exposure station. However, in the apparatus shown in FIG. 1, it is an electronic exposure station, for example, a laser or an LED printhead. When lasers and LED printheads are used it is common to expose the image areas and therefore tone the discharged areas at development station 10. In such systems the initial charge placed on the photoconductive member 1 by primary charger 7 determines the charge of the background areas in the toning process. Control of the level of that charge is important to control of background cleanness.

In some color electrophotographic apparatus, improvement in quality can be obtained by varying the initial charge on the photoconductor according to the color the image is to be toned.

Control and variation of the initial charge can be effected by a grid on primary charger 7. However, a preferred approach, presently known in the art, is to place an electroluminescent panel 15 between the primary charger 7 and the exposure station 8, which electroluminescent panel reduces the charge to the level desired by applying a uniform exposure to photoconductive member 1 of an amount that can be varied by a logic and control 4 of the apparatus.

The logic and control 4 can be programmed to vary the initial charge according to a variety of inputs, including the operator, service personnel, signals indicating the color toner to be applied and signals indicating a less than optimum toner image or charge level itself. As shown in FIG. 1, a potentiometer 9 senses the charge on a portion of the photoconductive member 1 after exposure and feeds that information into the logic and control 4 which information is used to adjust the illumination level of electroluminescent panel 15. This latter adjustment can correct for variations in either the primary charger or the electroluminescent panel itself.

Since a single charge level is sensed by potentiometer 9 and the panel 15 has a single level of illumination at any one time, variation in charge level across the photoconductive member 1 cannot be corrected for in this manner. Accordingly, it is important that electroluminescent panel 15 expose the photoconductive member 1 uniformly across its width, commonly called the cross-track direction.

To control the in-track width of the electroluminescent panel 15 seen by the photoconductive member 1, a low-cost mask is manufactured out of thin inexpensive plastic such as polyester which polyester has been made opaque in its manufacturing process. Unfortunately, such a mask has a tendency to bow in the center causing the photoconductive member 1 to be exposed more in that area because each point in the center of the moving photoconductive member spends more time under the electroluminescent panel than do points near the edges. To correct such bowing, in-track connecting strips can be placed directly across the aperture. However, such connecting strips permit very little exposure directly under them and have a worse effect on the ultimate image than the bowing. Another solution is to make the aperture narrower in the middle to compensate for the bowing. However, that solution requires that the bowing be consistent each time, which it is not.

Figure 2:
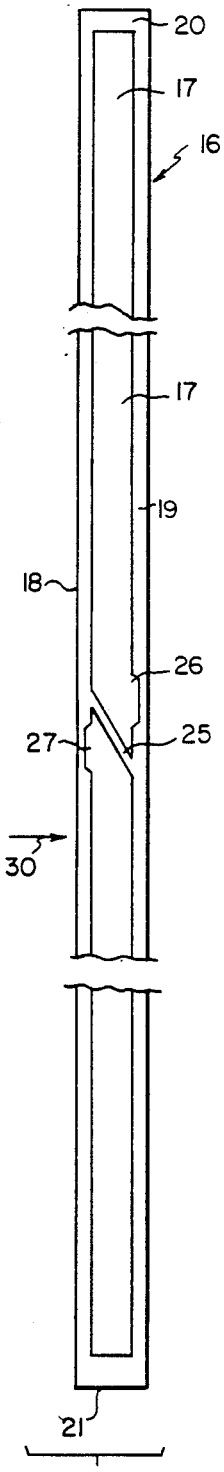
FIG. 2 is a top view of a mask for an electroluminescent panel used in the apparatus of FIG. 1.

According to FIG. 2, a mask 16 is cut from a thin elongated strip of plastic, for example, opaque polyester. The mask 16 can be fixed to the electroluminescent panel 15 by adhesive, or the like, to form an electroluminescent panel assembly as shown in FIG. 1. However, in a preferred approach, the mask is not adhesively fixed, but is held between the panel 15 and a casing 14 for the panel.

The mask 16 is rectangular in shape and has a rectangular aperture 17 forming two elongated cross-track strips of masking material 18 and 19 connected at their ends by a pair of short, in-track strips 20 and 21 positioned to be outside, preferably bordering, opposite edges of the intended exposure of photoconductive member 1.

To prevent the two elongated strips 18 and 19 from bowing one or more connecting or cross strips 25 connects them. Cross strip 25 is made oblique with respect to the intended direction 30 of relative movement of the photoconductive member 1. Since the cross strip 25 will also block the radiation from the electroluminescent panel 15 from reaching photoconductive member 1 elongated strips 18 and 19 have recessed portions 26 and 27 in in-track alignment with that cross strip which compensates for illumination masked by cross strip 25. Thus each point on the portion of the photoconductive member under aperture 17 is exposed for the same total amount of time as it passes under the mask 16.

Figure 3:
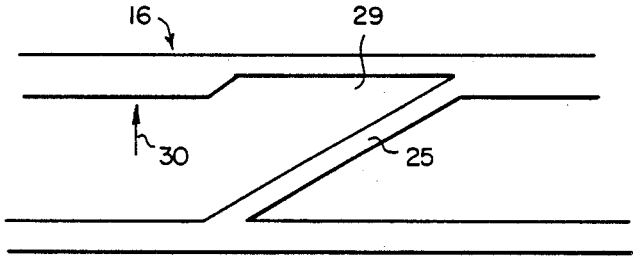
FIGS. 3 and 4 show alternative embodiments of a portion of the mask disclosed in FIG. 2.
Figure 4:
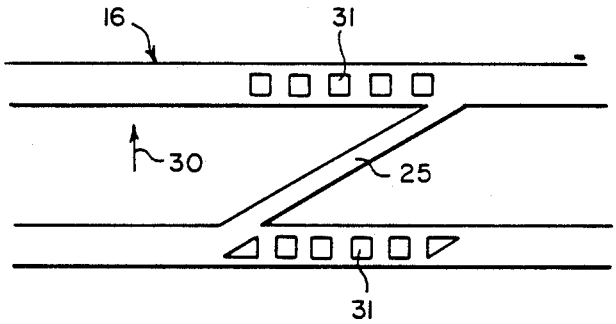

As shown in FIG. 3, the recesses 26 and 27 need not be in both elongate strips 18 and 19 but can be a single recess 29 totally in one strip. As shown in FIG. 4, they need not be recesses but they can be one or more apertures 31 in one or both of the elongated strips. Note that recesses 26, 27, 29 and apertures 31 include slanted ends to compensate for varying masking by connecting strip 25 as it intersects strips 18 and 19.

Once the principle as shown in FIGS. 2–4 is understood, other similar designs are well within the skill of the art. For example, the recesses can be in the outside edges of the elongated strips.

The invention has been described in detail with particular reference to a preferred embodiment thereof, but it will be understood that variations and modifications can be effected within the spirit and scope of the invention as described hereinabove and as defined in the appended claims. For example, the mask could be used to control processes (other than radiation exposure) in which a moving surface is moved past an elongated aperture and the process depends on the time each point on the surface is exposed to the aperture.

I claim:

1. A mask having a narrow elongated aperture for use in masking a surface of a member which member is moved across a short dimension of said aperture, said mask comprising means defining a narrow elongated aperture having elongated opposed sides, and at least one connecting strip of masking material connecting said elongated sides to maintain the width of the aperture, said connecting strip running obliquely with respect to the intended movement of said member, and a portion of one or both of said elongated sides being recessed to compensate for the portion of said member masked by said connecting strip.

2. For use with an elongated radiation emitting panel for exposing a member which member is moved across a short dimension of said panel during exposure, a mask for location between said panel and said member to control the amount of such exposure, said mask comprising:

two elongated strips of masking material, a short strip of masking material positioned outside each of opposite edges of the intended exposure of said member and connecting said elongated strips and defining a separation between them, and at least one connecting strip of masking material positioned between said short strips and within the intended exposure of said member and connecting said elongated strips to maintain their relative position, said connecting strip running obliquely with respect to the intended relative movement of said member, and portions of one or both of said elongated strips being missing to provide additional exposure to said member to compensate for exposure masked by said connecting strip.

3. For use with an elongated radiation emitting panel for exposing a member which member is moved across a short dimension of said panel during exposure, a mask for location between said panel and said member to control the amount of such exposure, said mask comprising a single strip of elongated rectangular shaped opaque masking material to be fit over said panel, said single strip having an elongated, generally rectangular aperture through which said member is exposed, said aperture being divided by at least one cross strip of said single strip, said cross strip running obliquely with respect to the intended relative movement of said member, and a portion or portions of said aperture aligned in the direction of motion of said member with said cross strip, being wider than the rest of said aperture to provide additional exposure to said member to compensate for exposure masked by said connecting strip.

4. An electroluminescent panel assembly for exposing a member which member is moved across a short dimension of said panel during exposure, said assembly comprising:

an elongated electroluminescent panel, a mask between said panel and said member to control the amount of such exposure, said mask including two elongated strips of masking material, means connecting and separating said elongated strips outside opposite edges of the intended exposure of said member, and at least one cross strip of masking material positioned between said connecting means and within the intended exposure of said member and connecting said elongated strips to maintain their relative position, said cross strip running obliquely with respect to the intended relative movement of said member, and portions of one or both of said elongated strips being missing to provide additional exposure to said member to compensate for exposure masked by said cross strip.

5. An assembly according to claim 4 wherein said one or more portions missing are one or more portions recessed from said elongated strips to expose the same portions of said member masked by said cross strip.

6. An assembly according to claim 5 wherein said one or more recessed portions are trapezoidal in shape.

7. An assembly according to claim 5 wherein said recessed portions include at least one trapezoidal portion recessed from the inside of each elongated strip.

8. An electrophotographic apparatus including a radiation sensitive member movable past a series of stations to form an electrostatic image on said member, said stations including means for applying a uniform charge to said member and means for uniformly exposing said member to radiation to uniformly reduce said charge to a desired level, said means for exposing comprising an electroluminescent panel assembly for exposing said member as the member is moved across a short dimension of said panel assembly during exposure, said assembly comprising:

an elongated electroluminescent panel, a mask between said panel and said member to control the amount of such exposure, said mask including two elongated strips of masking material, means connecting and separating said elongated strips outside opposite edges of the intended exposure of said member, and at least one cross strip of masking material positioned between said connecting means and within the intended exposure of said member and connecting said elongated strips to maintain their relative position, said cross strip running obliquely with respect to the intended relative movement of said member, and portions of one or both of said elongated strips being missing to provide additional exposure to said member to compensate for exposure masked by said cross strip.

* * * * *